US005516375A

United States Patent [19]

Ogawa et al.

[11] Patent Number: 5,516,375

[45] Date of Patent: May 14, 1996

[54] METHOD FOR MAKING TITANIUM ALLOY PRODUCTS

[75] Inventors: Atsushi Ogawa; Hiroshi Iizumi; Masakazu Niikura; Chiaki Ouchi, all of Kawasaki, Japan

[73] Assignee: NKK Corporation, Tokyo, Japan

[21] Appl. No.: 389,026

[22] Filed: Feb. 15, 1995

[30] Foreign Application Priority Data

Mar. 23, 1994 [JP] Japan ..... 6-051640

[51] Int. Cl.[6] ..... C21D 8/00

[52] U.S. Cl. ..... 148/564; 148/671

[58] Field of Search ..... 148/564, 669, 148/670, 671

[56] References Cited

U.S. PATENT DOCUMENTS

| | | | |
|---|---|---|---|
| 4,944,914 | 7/1990 | Ogawa et al. | 420/418 |
| 5,118,363 | 6/1992 | Chakrabarti et al. | 148/671 |
| 5,124,121 | 6/1992 | Ogawa et al. | 420/420 |
| 5,264,055 | 11/1993 | Champin et al. | 148/671 |
| 5,304,263 | 4/1994 | Champin et al. | 148/671 |

FOREIGN PATENT DOCUMENTS

| | | | |
|---|---|---|---|
| 0408313A1 | 1/1991 | European Pat. Off. . | |
| 0514293A1 | 11/1992 | European Pat. Off. . | |
| 52-4466 | 1/1977 | Japan | 148/564 |
| 63-219558 | 9/1988 | Japan . | |
| 1-272750 | 10/1989 | Japan . | |
| 2-70046 | 3/1990 | Japan | 148/564 |
| 3-274238 | 12/1991 | Japan . | |
| 05059510 | 3/1993 | Japan . | |
| 5-59509 | 3/1993 | Japan | 148/669 |
| 5-287406 | 11/1993 | Japan . | |

OTHER PUBLICATIONS

Patent Abstracts of Japan, vol. 017, No. 373 (C–1083) (Jul. 14, 1993) of JP–A–05 059510.

Patent Abstracts of Japan, vol. 013, No. 011 (C–558), (Jan. 11, 1989) of JP–A–63 219558.

Patent Abstracts of Japan, vol. 014, No. 037 (C–680), (Jan. 24, 1990) of JP–A–01 272750.

Patent Abstracts of Japan, vol. 018, No. 082 (C–1164), (Feb. 10, 1994) of JP–A–05 287406.

J. A. Wert et al, "Enhanced Superplasticity and Strength in Modified Ti–6A1–4V Alloys", Metallurgical Transactions A, vol. 14A, Dec. 1993, pp. 2535–2544.

Makoto Ohsumi et al, "A Study on Fabrication Method of Integrated Light Titanium Sheet Metal Structure by Superplastic Forming/Diffusion Bonding", Mitsubishi Heavy Industries Technical Review, vol. 20, No. 4, (1983–7) pp. 65–72.

*Primary Examiner*—John Sheehan

*Attorney, Agent, or Firm*—Frishauf, Holtz, Goodman, Langer & Chick

[57] ABSTRACT

A method for making titanium alloy products comprises the steps of:

superplastic-forming α+β-titanium alloy at a predetermined temperature, said α+β-titanium alloy consisting essentially of 3.45 to 5 wt. % Al, 2.1 to 5 wt. % V, 0.85 to 2.85 wt. % Mo, 0.85 to 3.15 wt. % Fe, 0.01 to 0.25 wt. % 0 and the balance being titanium;

cooling the superplastically formed titanium alloy at a cooling rate of 0.05 to 5° C./sec; and aging the cooled titanium alloy at a temperature of 400° to 600° C.

The superplastically formed titanium alloy can be diffusion-bonded, thereafter the diffusion-bonded titanium alloy can be cooled and aged.

34 Claims, 5 Drawing Sheets

● TENSILE STRENGTH AFTER AGING TREATMENT

○ TENSILE STRENGTH OF AS COOLED MATERIAL AFTER SUPERPLASTIC FORMING

THERMAL STRAIN (%)=d/L×100

METHOD FOR MAKING TITANIUM ALLOY PRODUCTS

BACKGROUND OF THE INVENTION

1. Field of the Invention

The present invention relates to a method for making titanium alloy products having high strength and ductility.

2. Description of the Related Arts

Titanium alloys have been widely used in aerospace applications for their advantages of high ductility and strength. In recent years, they have also been introduced in consumer product applications. High-strength type titanium alloys, typical of which is Ti-6Al-4V, however, have a disadvantage of high working cost due to their poor workability in general.

To overcome such a disadvantage, a superplastic forming/diffusion bonding method has been developed and used as a new forming method ("A Study on Fabrication Method of Integrated Light Titanium Sheet Metal Structure by Superplastic Forming/Diffusion Bonding", Makoto Ohsumi et al., Mitsubishi Heavy Industries Technical Review Vol. 20, No. 4, (1983–7), hereinafter called Prior Art 1). This forming method is to heat a titanium alloy to a predetermined temperature in α+β-phase, and to form it at a low strain rate, by which a component of a Final product shape or its similar shape can be formed.

However, the above-described forming method has problems as described below. For the most widely used Ti-6Al-4V alloy, the structure becomes coarse due to grain growth during superplastic forming because the superplastic forming temperature is as high as a temperature from 900° to 950° C., so that deterioration in mechanical properties (for example, decrease in strength and ductility) occurs.

For the Ti-6Al-4V alloy, the strength can be increased by rendering heat treatment of solution treatment and aging, but rapid cooling such as water quenching is needed in cooling after solution treatment. Therefore, it is almost impossible to apply this alloy to superplastically formed components. The superplastic forming is mainy applied to thin sheets. If a sheet component undergoes water quenching, quenching strains due to thermal stresses are developed, so that the component cannot function as a product.

Further, for the Ti-6Al-4V alloy, the reduction in forming cost is limited because of its high forming temperature. Therefore, the development of a titanium alloy which allows superplastic forming at lower temperatures has been attempted ("Enhanced Superplasticity and Strength in Modified Ti-6Al-4V Alloys", J. A. Wert and N. E. Paton, Metallurgical Transactions A, Volume 14A, December 1983, p.2535–2544, hereinafter called Prior Art 2).

In accordance with the requirements shown in Prior Art 2, some of the inventors of the present invention have developed a titanium alloy for superplastic forming which has a superplastic forming temperature 100° C. or more lower than that of the above-described Ti-6Al-4V alloy (Japanese Unexamined Patent Publication Laid-Open No. 3-274238, hereinafter called Prior Art 3). Specifically, the use of an alloy, whose typical composition is Ti-4.5Al-3V-2Mo-2Fe, remarkedly decreases the superplastic forming temperature.

In the above-mentioned Prior Arts 1 to 3, however, the following four problems remain to be solved.

Firstly, quenching strains are developed in solution treatment after superplastic forming, and high strength and ductility cannot necessarily be obtained by solution treatment and subsequent heat treatment.

Secondly, in terms of cost, it is undesirable to repeat the solution treatment on a superplastic component. Therefore, the establishment of an alternative, efficient manufacturing technique is expected.

Thirdly, deterioration in material properties takes place due to superplastic forming, so that their strength and ductility are prone to decrease.

Fourthly, the establishment of a superplastic forming/diffusion bonding process is expected so that it can achieve excellent diffusion bonding strength.

SUMMARY OF THE INVENTION

It is the first object of the invention to provide a method for making α+ β-titanium alloy products having high strength and ductility, which has a composition without generation of quenching strains after superplastic forming and without the need for solution treatment, by properly establishing the cooling conditions after superplastic forming and the subsequent heat treatment conditions.

It is the second object of the invention to provide a method for making α+β-titanium alloy products, which can efficiently obtain the superplastically formed products having high strength and high ductility.

It is the third object of the invention to provide a method for making α+β-titanium alloy products which produces less deterioration in material properties due to superplastic forming and has much higher strength and ductility.

It is the fourth object of the invention to provide a method for making α+β-titanium alloy products, which includes a diffusion bonding process capable of achieving excellent diffusion bonding strength.

From the viewpoint described below, the target value of the strength after superplastic forming was set at 105 kgf/mm$^2$, 5 percent higher than the strength of Ti-6Al-4V alloy, preferably 110 kgf/mm$^2$ , 10 percent higher The above-mentioned Prior Art 1 describes a fact that for the Ti-6Al-4V alloy, the strength decreases by 5 to 10 percent in superplastic forming, and the tensile strength after superplastic forming is about 100 kgf/mm$^2$. Normally, in order for a new material or new process to be used, it is said that the enhancement in properties by 5 percent to 10 percent or more is needed. Therefore, in this application, tentative target properties were set at 5 to 10 percent improvement on the strength of the Ti-6Al-4V alloy.

To attain the above-mentioned objects, the present invention provides a method for making titanium alloy products comprising the steps of:

superplastic forming α+β-titanium alloy at a predetermined temperature, said α+β-titanium alloy consisting essentially of 3.45 to 5 wt. % Al, 2.1 to 5 wt. % V, 0.85 to 2.85 wt. % Mo, 0.85 to 3.15 wt. % Fe, 0.01 to 0.25 wt. % 0 and the balance being titanium;

cooling the superplastically formed titanium alloy at a cooling rate of 0.05 to 5° C./sec; and aging the cooled titanium alloy at a temperature of 400° to 600° C.

The present invention provides another method for making titanium alloy products comprising the steps of:

superplastic forming α+β-titanium alloy at a predetermined superplastic-forming temperature, said α+β -titanium alloy consisting essentially of 3.45 to 5 wt. % Al, 2.1 to 5 wt.

% V, 0.85 to 2.85 wt. % Mo, 0.85 to 3.15 wt. % Fe, 0.01 to 0.25 wt. % 0 and the balance being titanium;

heating the superplastically formed titanium alloy to a temperature ranging from the superplastic-forming temperature plus 5° C. to less than β -transus;

cooling the heated titanium alloy at a cooling rate of 0.05° to 5° C./sec; and aging the cooled titanium alloy at a temperature of 400° to 600° C.

The present invention provides still another method for making titanium alloy products comprising the steps of:

superplastic forming α+β-titanium alloy at a predetermined superplastic-forming temperature, said α+β-titanium alloy consisting essentially of 3.45 to 5 wt. % Al, 2.1 to 5 wt. % V, 0.85 to 2.85 wt. % Mo, 0.85 to 3.15 wt. % Fe, 0.01 to 0.25 wt. % 0 and the balance being titanium;

heating the superplastically formed titanium alloy to a temperature ranging from the superplastic-forming temperature plus 5° C. to less than β-transus;

diffusion-bonding the heated titanium alloy;

cooling the diffusion-bonded titanium alloy at a cooling rate of 0.05° to 5° C./sec; and aging the cooled titanium alloy at a temperature of 400° to 600° C.

DESCRIPTION OF THE PREFERRED EMBODIMENT

Figure 1:
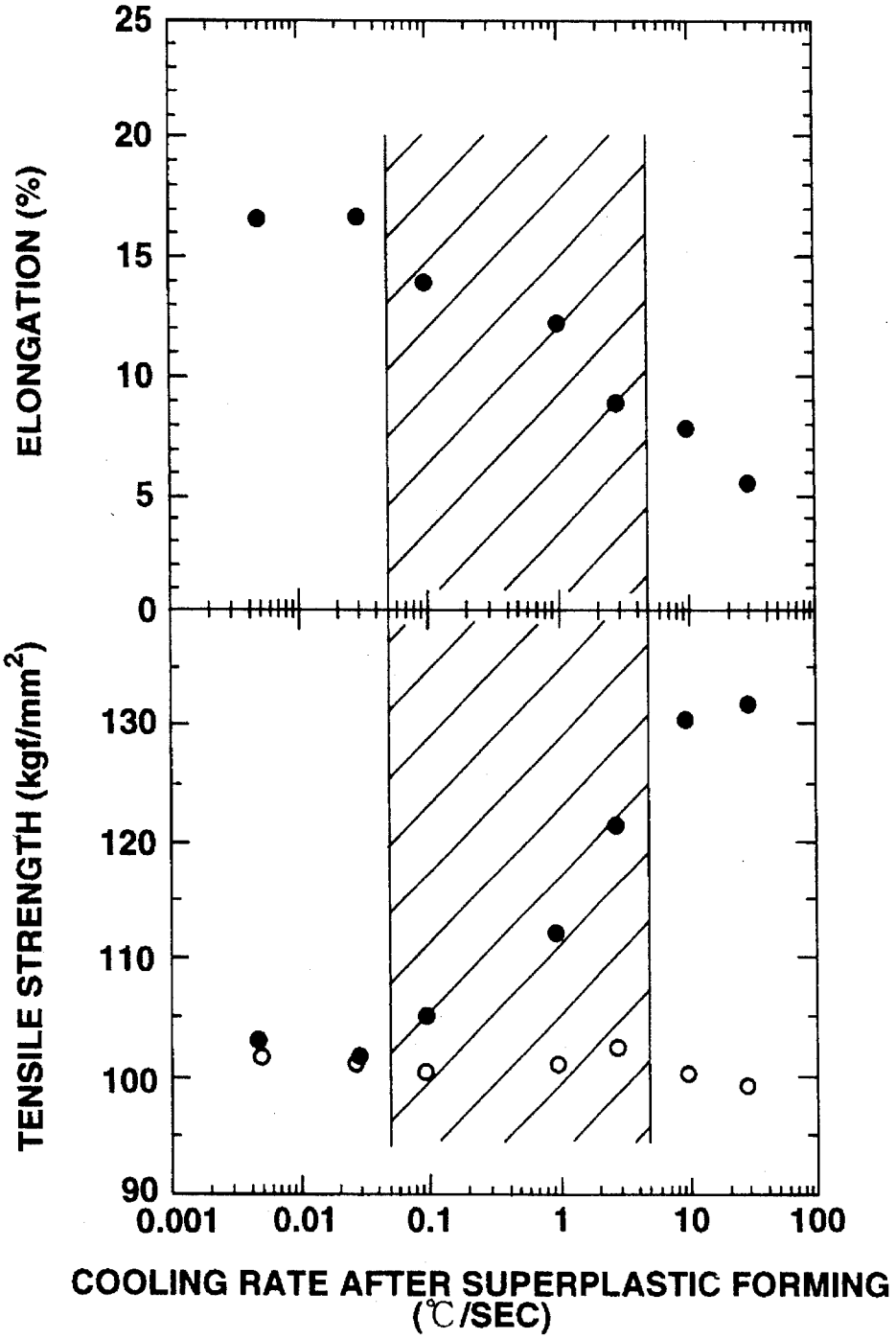
FIG. 1 shows the effect of cooling rate after superplastic forming on tensile properties after aging treatment.

The inventors obtained the following knowledge as a result of repeated studies made earnestly to find an alloy having such properties and its manufacturing conditions.

We found that some of the α+β-titanium alloys having the chemical composition disclosed in the above-mentioned Prior Art 3 are alloys having a component suitable for solving the above problems. We also found that a technique for manufacturing a superplastically formed component having much higher strength and ductility than before can be established by performing heat treatment by a method described below after these alloys are superplastically formed, and a formed component having excellent strength in diffusion bonding can be manufactured. As a result of further detailed studies made focusing on this point, we found that there exists a composition which is not included in Prior Art 3 but can achieve the same effect.

Specifically, it was found that the above first and second problems can be solved by specifying a chemical composition from the above viewpoint, by performing cooling after solution treatment at a proper cooling rate which can offer high strength and ductility after aging treatment without giving thermal strains to the formed component after superplastic forming, and subsequently by performing aging treatment in a proper temperature range.

Also, it was found that the third problem can be solved by heating the formed component to a predetermined temperature without being cooled to room temperature after forming is performed at an optimum superplastic forming temperature at which the structure does not become coarse during the superplastic forming and by subsequently performing the above-mentioned heat treatment, and even higher strength can be attained.

Furthermore, it as found that for the fourth problem, both of the bonding strength and the strength of the formed component can be improved at the same time by increasing the temperature of the formed component to perform diffusion bonding after superplastic forming, and a superplastic forming/diffusion bonding process can be established.

Next, the present invention .ill be described in detail.

First, the reasons why the chemical composition is limited as described above in the present invention .ill be described.

Al (aluminum): Al is one of α stabilizing elements, and the clement indispensable to the α+β-titanium alloy. If Al content is less than 3.45 wt %, sufficient strength cannot be obtained. If Al content exceeds 5 wt %, the workability, especially at low temperatures, significantly deteriorates, and the fatigue life strength worsens. Therefore, Al content was specified at the range from 3.45 to 5 wt %.

O (oxygen): Oxygen content equal to that of the ordinary α+β-titanium alloy is desirable. If oxygen content is less than 0.01 wt %, the contribution to the increase in strength is insufficient, and if oxygen content exceeds 0.25 wt %, the ductility decreases. Therefore, oxygen content .as specified at the range from 0.01 to 0.25 wt %.

V (vanadium): V has little effect of stabilizing β-phase, but it is an important element to reduce the β-transus. However, if V content is less than 2 1 wt % the reduction in β-transus is insufficient, and the effect of stabilizing β- phase cannot be achieved. If V content exceeds 5.0 wt %, the stability of β-phase becomes too high, so that the increase in strength due to aging treatment cannot be obtained sufficiently, and the cost becomes high because V is an expensive element. Therefore, V content was specified at the range from 2.1 to 5.0 wt. %.

Mo (molybdenum): Mo has effects of stabilizing β -phase and retarding grain growth. However, if Mo content is less than 0.85 wt %, crystal grains become coarse in annealing, so that the desired effect cannot be achieved. If Mo content exceeds 2.85 wt %, the stability of β -phase becomes too high, so that the increase in strength due to aging treatment cannot be obtained. Therefore, Mo content was specified at 0.85 to 2.85 wt. %.

Fe (iron): Fe stabilizes β-phase, especially strengthening β-phase, and greatly contributes to the increase in strength after solution and aging treatment. Also, because Fe has a high diffusivity in titanium, it has an effect of reducing the deformation resistance in superplastic forming, and improves diffusion bonding properties. If Fe content is less than 0.85 wt %, the effect of strengthening is insufficient, and both of the effect of reducing the deformation resistance in superplastic forming and the effect of improving the diffusion bonding properties are insufficient. If Fe content exceeds 3.15 wt %, the stability of β-phase becomes too high, so that the superplastic properties deteriorate, and the increase in strength in aging treatment cannot be obtained. Therefore, Fe content was specified at 0.85 to 3.15 wt %.

Impurity elements normally contained in the α+β-titanium alloy and other additional elements which have no influence on the effects of the present invention are allowed.

Next, the reasons why the cooling conditions and heat treatment conditions after superplastic forming are limited are described below.

The cooling rate after superplastic forming must be one which is not too high in order to prevent thermal strains and must be one which is not too low in order to obtain a sufficient increase in strength after aging treatment. If the cooling rate is too high, the strength after aging treatment becomes too high, the ductility being lost, so that the formed component cannot be used as a practical component. Therefore, the cooling rate after superplastic forming was specified at 0.05° to 5 ° C./sec in consideration of above factors.

FIG. 1 shows tensile properties of superplastically formed components at room temperature. The superplastically formed components were manufactured as follows: After a Ti-4.38% Al- 3.02%V-2.03%Mo-1.91%Fe-0.085%0 alloy was superplastically formed at 795° C., the formed component was cooled to room temperature at different cooling rates, and subsequently aging treatment was performed at 510° C. for 6 hours. As seen from FIG. 1, if the cooling rate is lower than 0.05° C./sec, the increase in strength after aging treatment cannot be obtained. If the cooling rate exceeds 5° C./sec, a decrease in ductility is found though the strength is high, the elongation being less than 5%, which presents a problem in practical use. Also, at cooling rates exceeding 5° C./sec, large thermal strains were produced on the formed body after superplastic forming.

In case that the cooling rate is 0.05° to 1° C./sec, more preferable elongation is obtained. In case that the cooling rate is 1° to 5° C./sec, more preferable strength is obtained, The cooling rate of 0.3° to 1° C./sec is more desirable in elongation and strength.

If the aging treatment temperature is lower than 400° C., the temperature is too low to improve the strength after aging treatment. If the aging treatment temperature exceeds 600° C., the strength enhancement is undesirably lost due to "over-aging". Therefore, the aging treatment temperature was specified at the range from 400° to 600° C.

In case that aging treatment temperature is 400° to 500° C., more preferable tensile strength is obtained. In case that aging treatment temperature is 500° to 600° C., more preferable elongation is obtained. In case that aging treatment temperature is 450° to 550° C., more preferable 0.2% proof stress and tensile strength are obtained.

A α+β-titanium alloy having high strength and ductility can be obtained under the above conditions. In this case, the deterioration in material properties due to superplastic forming is inhibited, so that much higher strength can be obtained, by increasing the temperature of the formed body in a predetermined range after superplastic forming, and then by performing cooling and aging treatment under the above conditions. At this time, if the increased temperature range is less than 5° C., the effect is not found, and if the increased temperature is not lower than the β-transus of that material, the microstructure becomes coarse, so that the mechanical properties after aging treatment, especially the ductility, deteriorate. Therefore, the temperature increased at this time was specified at a temperature which is 5° C. or more higher than the superplastic forming temperature and lower than the β-transus. To further increase the strength, it is preferable that the increased temperature be 25° C. or more higher than the superplastic forming temperature. In this case, it is desirable that the heating treatment is performed in a superplastic forming apparatus without cooling the formed component to room temperature.

Sufficient bonding strength can be obtained even if diffusion bonding is performed at the superplastic forming temperature after superplastic forming. Also, far higher bonding strength can be obtained by increasing the temperature of the superplastically formed component in a predetermined range to perform diffusion bonding after superplastic forming, and then by performing cooling and aging treatment under the above conditions. At this time, if the increased temperature range is less than 5° C., the effect is not found, and if the increased temperature is not lower than the β-transus of that material, the microstructure becomes coarse, so that the mechanical properties after aging treatment, especially the ductility, deteriorate. Therefore, the temperature increased at this time was specified at a temperature which is 5° C. or more higher than the superplastic forming temperature and lower than the β-transus. To further increase the strength, it is preferable that the increased temperature be 25° C. or more higher than the superplastic forming temperature. In this case too, it is desirable that the heating treatment is performed in a superplastic forming apparatus without cooling the formed component to room temperature.

The superplastic forming is carried out at a temperature of at most β-transus. The temperature of 750° to 825° C. is more preferable.

EXAMPLE

Next, the examples of the present invention will be described in detail.

Example-1

After an ingot of α+β-titanium alloy which contains 4.38 wt % Al, 3.02 wt % V, 2.03 wt % Mo, 1.91 wt % Fe, 0.085 wt % 0, 0.01 wt % C, 0.006 wt % N, and 0.0085 wt % H, and has a β-transus of 895° C. was heated to β-phase region and forged, the forged material was heated to α+β-phase region, and formed into a 2 mm-thick sheet by hot rolling. After being superplastically formed at 795° C., this sheet material was cooled to room temperature at a cooling rate of 0.005° to 30° C./sec, and then underwent aging treatment at 510° C. for 6 hours. The relationship between the cooling rate and the tensile properties at room temperature for this example is shown in Table 1 and FIG. 1.

TABLE 1

| Cooling rate (°C./sec) | Tensile strength after cooling (kgf/mm²) | Tensile strength after aging (kgf/mm²) | Elongation after aging (%) | Thermal strain after cooling (%) |
|---|---|---|---|---|
| 0.005 | 101.5 | 102.8 | 16.4 | <1 |
| 0.03 | 100.8 | 101.2 | 16.0 | <1 |
| 0.1 | 99.8 | 105.2 | 13.6 | <1 |
| 0.3 | 100.4 | 111.5 | 11.8 | <1 |
| 1 | 101.8 | 120.5 | 8.4 | <1 |
| 3 | 99.5 | 129.4 | 7.3 | <1 |
| 10 | 98.3 | 130.5 | 4.9 | 1.6 |
| 30 | 98.0 | 130.2 | 4.6 | 3.2 |

From Table 1 and FIG. 1, it is seen that if the cooling rate after superplastic forming is lower than 0.05° C./sec, the increase in strength cannot be obtained, and if the cooling rate exceeds 5° C./sec, the elongation is less than 5% though high strength can be obtained, which presents a problem in practical use. It is found that if the cooling rate is in the range of 0.05° to 5° C./sec, both of the strength and the elongation take satisfactory values.

Figure 3:
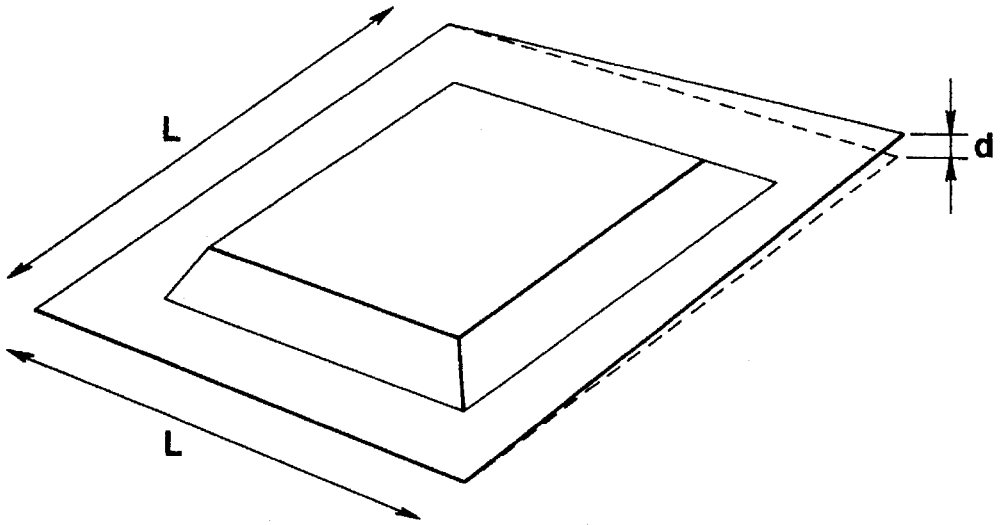
FIG. 3 shows a method of measuring thermal strain of superplastically formed product after cooling.

Table 1 also shows the relationship between the thermal strain and the cooling rate for the formed component after superplastic forming and cooling. If the cooling rate exceeds 5° C./sec, the occurrence of remarkable thermal strain is found. The thermal strain was evaluated by using a value obtained by dividing the maximum value of the floating height from a surface plate by the length of side of the formed component. The floating height was measured with the superplastically formed component being placed on a surface plate as shown in FIG. 3.

Figure 2:
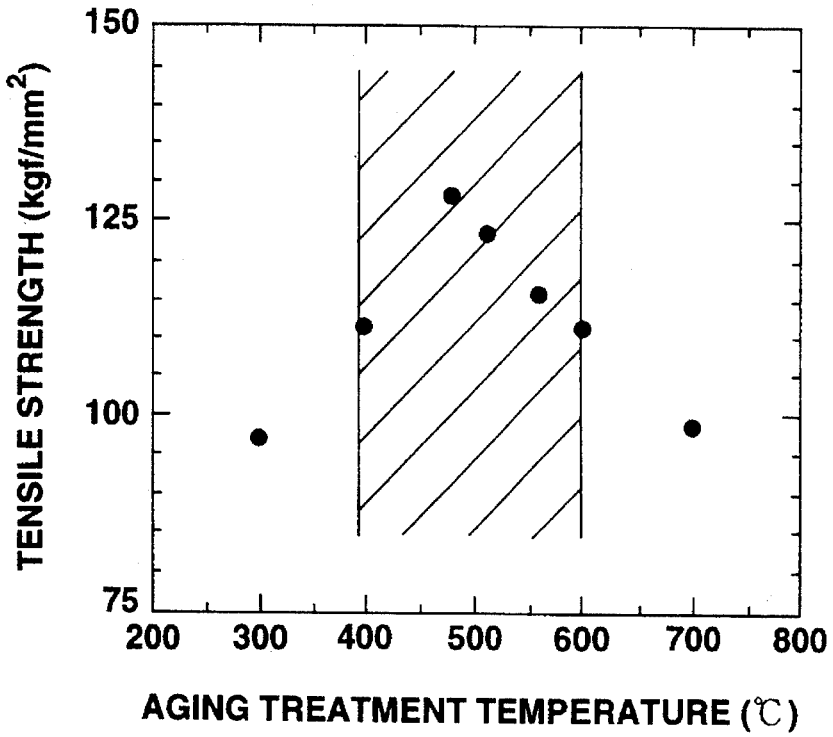
FIG. 2 shows the effect of aging treatment temperature on tensile strength of superplastically formed product.

Next, after being superplastically formed at 795° C. in the same manner as described above, a titanium alloy sheet having the above chemical composition was cooled to room temperature at a cooling rate of 1° C./sec, and then underwent aging treatment in the temperature range of 300° to 700° C. for 1 hour to evaluate the tensile properties at room temperature. The results are shown in Table 2 and FIG. 2. As seen from Table 2 and FIG. 2, if the aging treatment temperature is lower than 400° C., aging hardening is insufficient, and if the temperature exceeds 600° C., softening due to overaging occurs, so that the target strength not lower than 110 kgf/mm$^2$ cannot be obtained.

TABLE 2

| Aging treatment temperature | 0.2% proof stress (kgf/mm$^2$) | Tensile strength (kgf/mm$^2$) | Elongation (%) |
|---|---|---|---|
| 300° C. | 99.7 | 104.3 | 18.5 |
| 400° C. | 100.1 | 110.6 | 16.4 |
| 480° C. | 108.3 | 127.5 | 10.1 |
| 510° C. | 106.0 | 122.4 | 12.2 |
| 560° C. | 105.2 | 114.1 | 13.5 |
| 600° C. | 102.4 | 109.9 | 15.8 |
| 700° C. | 95.4 | 100.6 | 17.9 |

Example 2

After an ingot of α+β-titanium alloy which contains 4.52 wt % Al, 3.21 wt % V, 1.89 wt % Mo, 2.07 wt % Fe, 0.114 wt % 0, 0.01 wt % C, 0.008 wt % N, and 0.0045 wt % H, and has a β-transus of 905° C. was heated to β-phase region and forged, the forged material was heated to α+β-phase region, and formed into a 3 mm-thick sheet by hot rolling. After this sheet material is superplastically formed at 775° C., the formed body was heated to temperatures from 778° C. (superplastic forming temperature +3° C.) to 915° C. (β-transus+10° C.), cooled to room temperature at a cooling rate of 0.5° C./sec and successively underwent aging treatment at 480° C. for 3 hours. The relationship between the heating temperature after superplastic forming and the tensile properties after aging treatment for this example is shown in Table 3 and FIG. 4. The tensile properties of a material which was cooled to room temperature at a cooling rate of 0.5° C./sec without being heated after superplastic forming and underwent aging treatment at 480° C. for 3 hours are shown in Table 3 for comparison.

Figure 4:
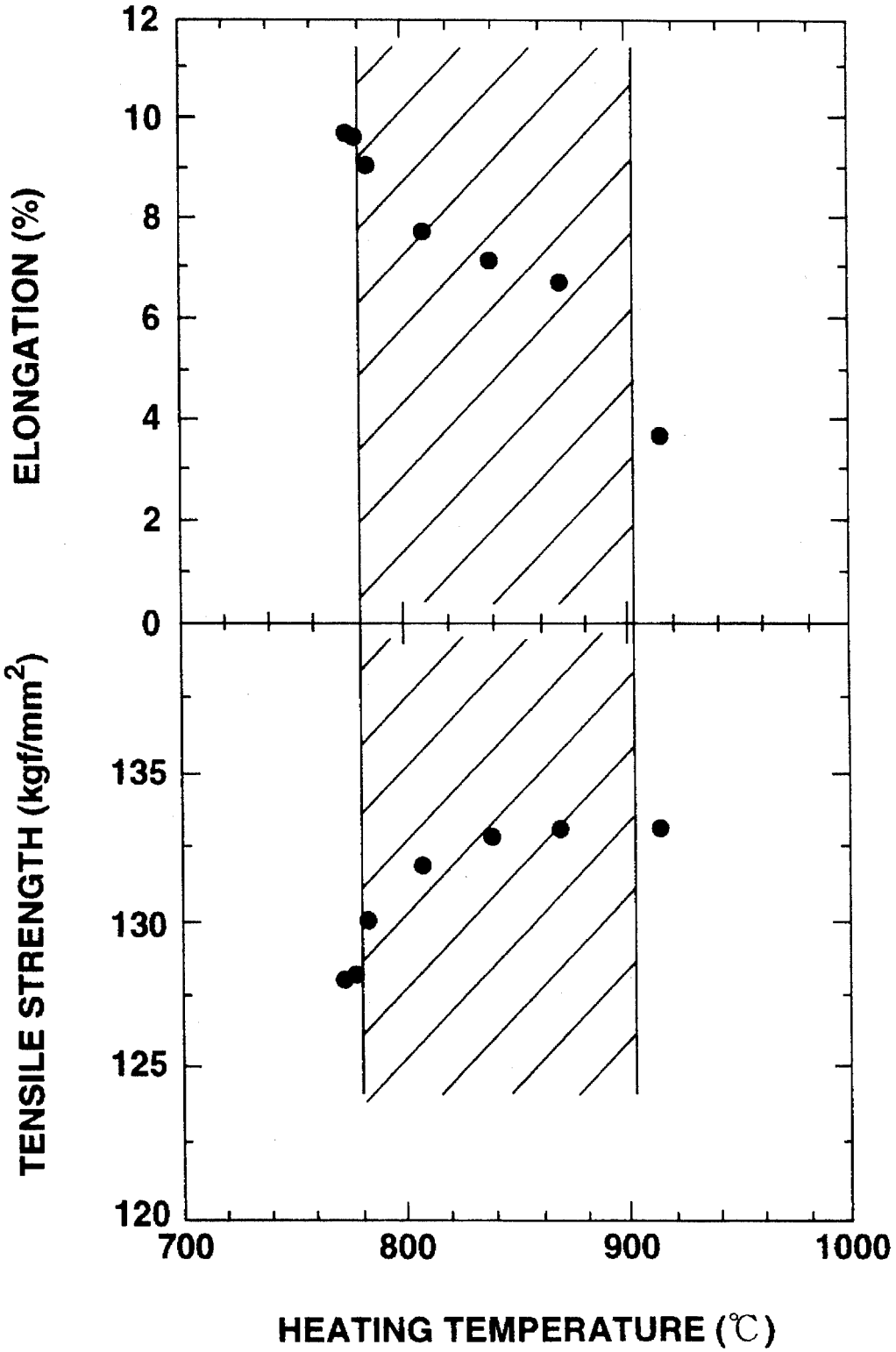
FIG. 4 shows the effect of heating temperature after superplastic forming on tensile properties after aging treatment.

From Table 3 and FIG. 4, it is seen that the increase in strength can be obtained by heating the formed body by 5° C. or more at a temperature which is lower than the β-transus. Particularly for the formed component heated to a temperature not lower than the superplastic forming temperature plus 25° C., much higher strength can be obtained.

TABLE 3

| Heating Temperature | 0.2% proof stress (kgf/mm$^2$) | Tensile Strength (kgf/mm$^2$) | Elongation (%) |
|---|---|---|---|
| 775° C. | 109.2 | 128.0 | 9.6 |
| 778° C. | 109.3 | 128.1 | 9.5 |
| 785° C. | 110.8 | 129.9 | 9.0 |
| 810° C. | 112.6 | 131.8 | 7.6 |
| 840° C. | 114.5 | 132.7 | 7.0 |
| 870° C. | 114.8 | 133.0 | 6.6 |
| 915° C. | 114.6 | 132.9 | 3.5 |

Example 3

The titanium alloy sheet (3 mm thickness) shown in Example 2 is superplastically formed at 810° C., successively subjected to diffusion bonding at that temperature, then cooled to room temperature at 1° C./sec, and underwent aging treatment at 510° C. for 6 hours. The tensile properties of the superplastically formed portion at this time is shown in Table 4.

From this result, it is found that the same effects as those of Example 2 can be obtained even when diffusion bonding is performed after superplastic forming.

TABLE 4

| | 0.2% proof stress (kgf/mm$^2$) | Tensile strength (kgf/mm$^2$) | Elongation (kgf/mm$^2$) |
|---|---|---|---|
| As cooled | 94.0 | 100.7 | 12.8 |
| After aging treatment | 110.4 | 120.0 | 8.3 |

Example 4

The titanium alloy sheet (2 mm thickness) shown in Example 1 is superplastically formed at 795° C., successively heated to 820° C., subjected to diffusion bonding at that temperature, then cooled to room temperature at 1° C./sec, and underwent aging treatment at 510° C. for 6 hours. The tensile properties of the superplastically formed portion for this example is shown in Table 5.

As seen from Table 5, the same effects as those of Example 2 can be obtained even when heating and diffusion bonding are performed after superplastic forming.

TABLE 5

| | 0.2% proof stress (kgf/mm$^2$) | Tensile strength (kgf/mm$^2$) | Elongation (kgf/mm$^2$) |
|---|---|---|---|
| As cooled | 94.9 | 101.5 | 11.7 |
| After aging treatment | 112.5 | 122.3 | 7.9 |

Example 5

Figure 5:
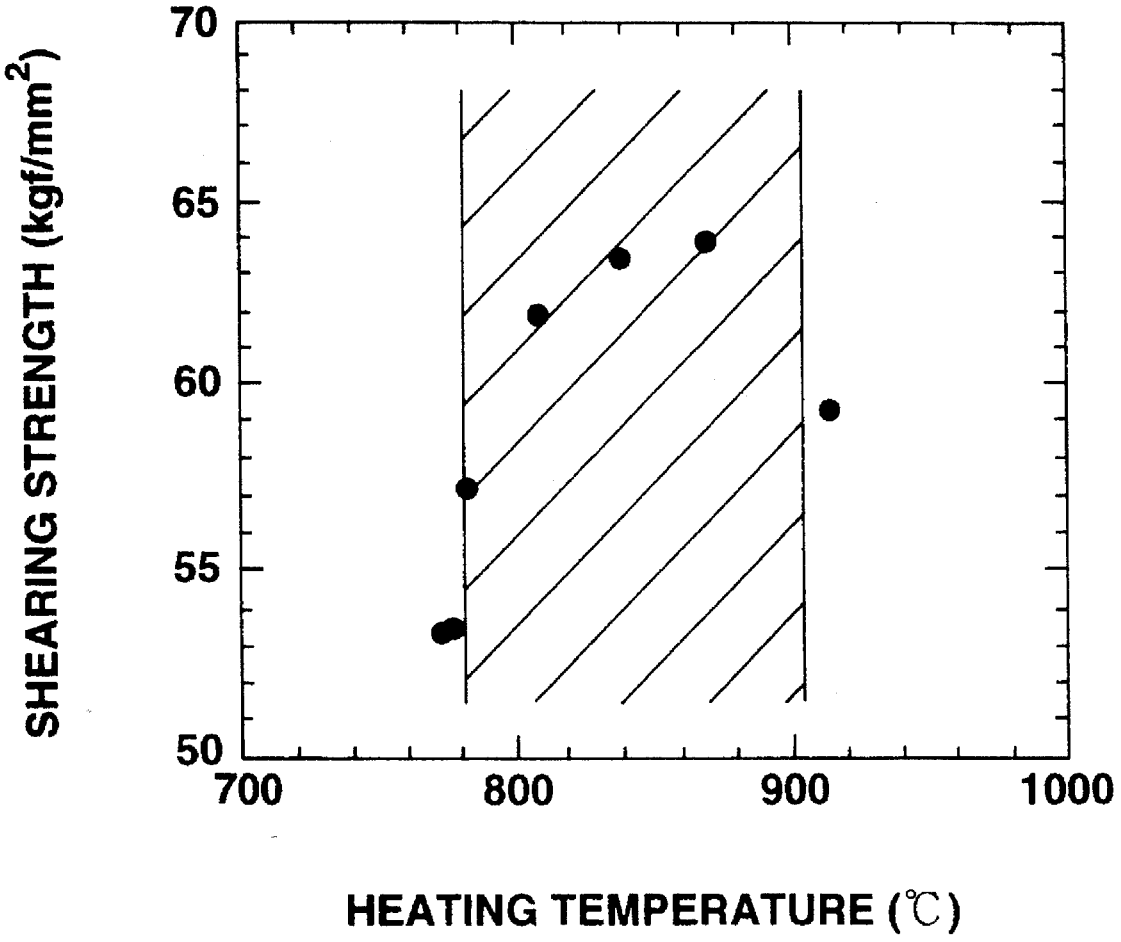
FIG. 5 shows the effect of diffusion bonding temperature after superplastic forming on diffusion bonding strength after aging treatment.
Figure 6:
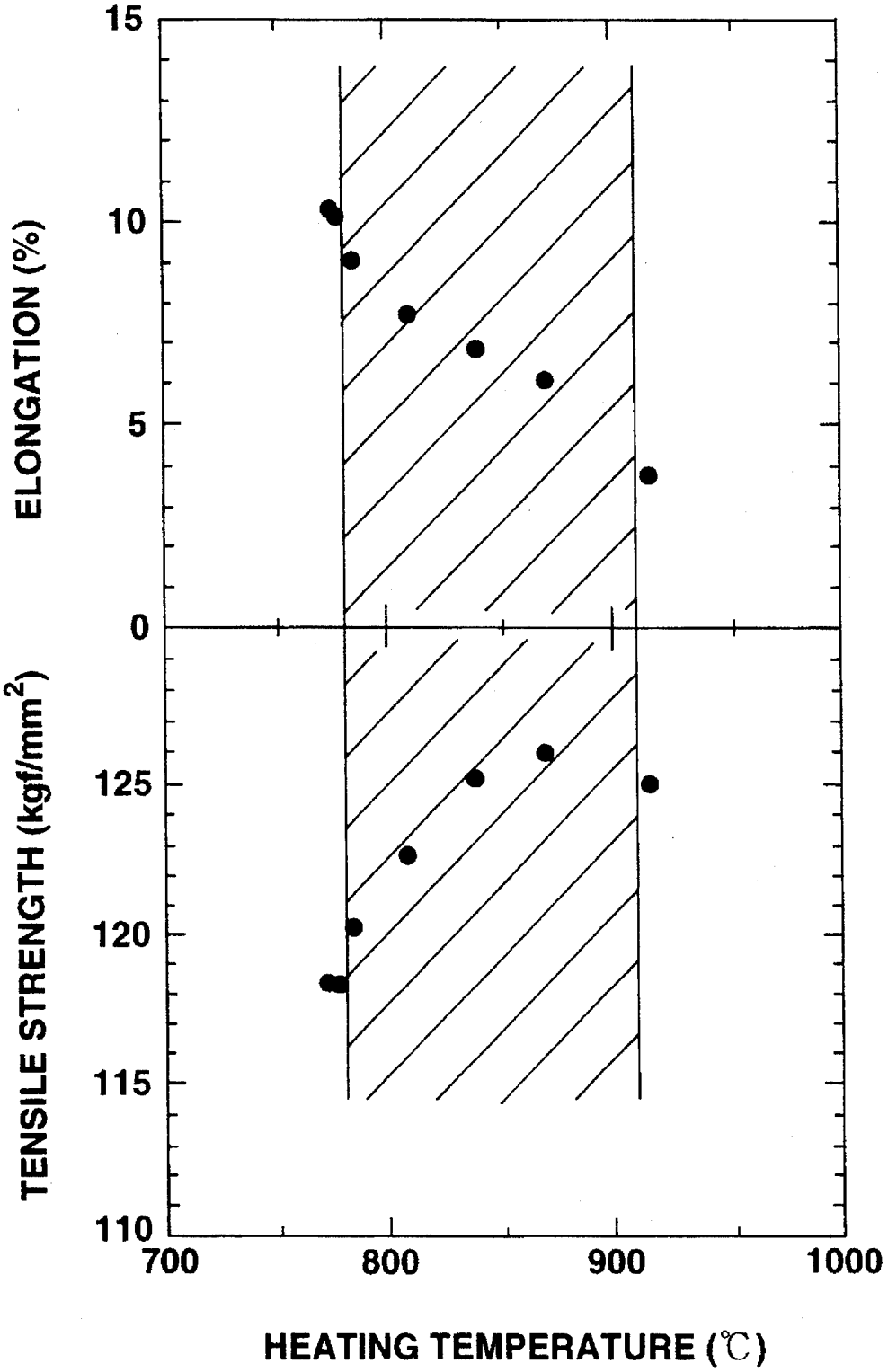
FIG. 6 shows the effect of diffusion bonding temperature after superplastic forming on tensile properties after aging treatment.

The titanium alloy sheet (2 mm thickness) shown in Example 1 is superplastically formed at 775° C., successively heated to temperatures from 778° to 910° C., subjected to diffusion bonding at those temperatures, then cooled to room temperature at 0.5° C./sec, and underwent aging treatment at 510° C. for 6 hours. The relationship between the diffusion bonding temperature and the bonding strength of the diffusion bonded portion is shown in Table 6 and FIG. 5, and the relationship between the diffusion bonding temperature and the strength of the superplastically formed portion is shown in Table 7 and FIG. 6.

TABLE 6

| Heating temperature | Shearing strength of diffusion bonded portion (kgf/mm$^2$) |
|---|---|
| 775° C. | 53.2 |
| 778° C. | 53.3 |
| 785° C. | 57.0 |
| 810° C. | 61.6 |
| 840° C. | 63.1 |
| 870° C. | 63.5 |
| 915° C. | 58.9 |

TABLE 7

| Heating Temperature | 0.2% proof stress (kgf/mm$^2$) | Tensile strength (kgf/mm$^2$) | Elongation (%) |
|---|---|---|---|
| 775° C. | 100.9 | 118.4 | 10.2 |
| 778° C. | 101.3 | 118.3 | 10.1 |
| 785° C. | 104.5 | 120.2 | 9.0 |
| 810° C. | 106.3 | 122.5 | 7.6 |
| 840° C. | 108.4 | 125.0 | 6.7 |
| 870° C. | 108.6 | 125.8 | 5.9 |
| 915° C. | 106.9 | 124.7 | 3.5 |

From the figures in the tables above, it is found that both of the bonding strength and the strength of the superplastic-formed portion are increased by performing heating and diffusion bonding after superplastic forming.

What is claimed is:

1. A method for making a titanium alloy product comprising the steps of:

superplastic forming α+β-titanium alloy at a temperature of at most β-transus, said α+β-titanium alloy consisting essentially of 3.45 to 5 wt. % Al, 2.1 to 5 wt. % V, 0.85 to 2.85 wt. % Mo, 0.85 to 3.15 wt. % Fe, 0.01 to 0.25 wt. % 0 and the balance being titanium;

cooling the superplastically formed titanium alloy at a cooling rate of 0.05° to 5° C./sec; and aging the cooled titanium alloy at a temperature of 400° to 600° C.

2. The method of claim 1, wherein said cooling rate of the the titanium alloy is 0.05° to 1° C./sec.

3. The method of claim 2, wherein said cooling rate of the the titanium alloy is 0.3° to 1° C./sec.

4. The method of claim 1, wherein said cooling rate of the titanium alloy is 1° to 5° C./sec.

5. The method of claim 1, wherein said aging temperature is 400° to 500° C.

6. The method of claim 1, wherein said aging temperature is 500° to 600° C.

7. The method of claim 1, wherein said aging temperature is 450° to 550° C.

8. The method of claim 1, wherein said temperature of the step of superplastic forming is 750° to 825° C.

9. The method of claim 1, further comprising the step of:

diffusion-bonding at least two of the superplastically formed titanium alloy products.

10. The method of claim 1, wherein said α+β-titanium alloy consists essentially of 4.38 wt. % Al, 3.02 wt. % V, 2.38 wt. % Mo, 1.91 wt. % Fe, 0.085 wt. % 0 and the balance being titanium;

said temperature of the step of superplastic-forming is 795° C.

said cooling rate of the titanium alloy is 0.1° to 3° C./sec; and said aging is performed at 510° C. for 6 hours.

11. The method of claim 1, wherein said α+β-titanium alloy consists essentially of 4.38 wt % Al, 3.02 wt. % V, 2.38 wt. % Mo, 1.91 wt. % Fe, 0.085 wt. % 0 and the balance being titanium;

said temperature of the step of superplastic forming is 795 ° C.;

said cooling rate of the titanium alloy is 1° C./sec; and said aging is performed at a temperature of 400° to 600° C. for 1 hours.

12. A method for making a titanium alloy formed product comprising the steps of:

superplastic-forming α+β-titanium alloy at a temperature below β-transus minus 5° C., said α+β-titanium alloy consisting essentially of 3.45 to 5 wt. % Al, 2.1 to 5 wt. % V, 0.85 to 2.85 wt. % Mo, 0.85 to 3.15 wt. % Fe, 0.01 to 0.25 wt. % 0 and the balance being titanium;

heating the superplastically formed titanium alloy to a temperature ranging from the superplastic-forming temperature plus 5° C. to less than β-transus;

cooling the heated superplastically formed titanium alloy at a cooling rate of 0.05° to 5° C./sec; and aging the cooled superplastically formed titanium alloy at a temperature of 400° to 600° C.

13. The method of claim 12, wherein the superplastic-forming temperature is below β-transus minus 25° C., and the superplastically formed titanium alloy is heated to a temperature ranging from the superplastic-forming temperature plus 25° C. to less than β-transus.

14. The method of claim 12, wherein the superplastically formed titanium alloy is heated in a superplastic-forming apparatus.

15. The method of claim 12, wherein said cooling rate of the the titanium alloy is 0.05° to 1° C./sec.

16. The method of claim 15, wherein said cooling rate of the the titanium alloy is 0.3° to 1° C./sec.

17. The method of claim 12, wherein said cooling rate of the titanium alloy is 1° to 5° C./sec.

18. The method of claim 12, wherein said aging temperature is 400° to 500° C.

19. The method of claim 12, wherein said aging temperature is 500° to 600° C.

20. The method of claim 12, wherein said aging temperature is 450° to 550° C.

21. The method of claim 12, wherein said temperature of the step of superplastic-forming is 750° to 825° C.

22. The method of claim 12, wherein said α+β-titanium alloy consists essentially of 4.52 wt. % Al, 3.21 wt. % V, 1.89 wt. % Mo, 2.07 wt. % Fe, 0.114 wt. % 0 and the balance being titanium;

said temperature of the step of superplastic-forming is 775° C.;

the superplastically formed titanium alloy is heated to a temperature ranging from 785° C. to 870° C.;

said cooling rate of the titanium alloy is 0.5° C./sec; and said aging is performed at 480° C. for 3 hours.

23. A method for making a titanium alloy product comprising the steps of:

superplastic-forming at least two components of α+β-titanium alloy at a temperature below β-transus minus 5° C., said α+β-titanium alloy consisting essentially of 3.45 to 5 wt. % Al, 2.1 to 5 wt % V, 0.85 to 2.85 wt. % Mo, 0.85 to 3.15 wt. % Fe, 0.01 to 0.25 wt. % 0 and the balance being titanium;

heating each superplastically formed titanium alloy component to a temperature ranging from the superplastic-forming temperature plus 5° C. to less than β-transus;

diffusion-bonding the heated titanium alloy components to each other;

cooling the diffusion-bonded titanium alloy components at a cooling rate of 0.05° to 5° C./sec; and aging the cooled titanium alloy components at a temperature of 400° to 600° C.

24. The method of claims 23, wherein the superplastic forming temperature is below β-transus minus 25° C. and the superplastically formed titanium alloy components are heated to a temperature ranging from a temperature of superplastic-forming temperature plus 25° C. to less than β-transus.

25. The method of claim 23, wherein the superplastic-formed titanium alloy is heated in a superplastic-forming apparatus.

26. The method of claim 23, wherein said cooling rate of the the titanium alloy is 0.05° to 1° C./sec.

27. The method of claim 26, wherein said cooling rate of the the titanium alloy is 0.3° to 1° C./sec.

28. The method of claim 23, wherein said cooling rate of the titanium alloy is 1 to 5° C./sec.

29. The method of claim 23, wherein said aging temperature is 400° to 500° C.

30. The method of claim 23, wherein said aging temperature is 500° to 600° C.

31. The method of claim 23, wherein said aging temperature is 450° to 550° C.

32.The method of claim 23, wherein said predetermined temperature of the step of superplastic-forming is 750° to 825° C.

33. The method of claim 23, wherein said α+β-titanium alloy consists essentially of 4.38 wt. % Al, 3.02 wt. % V, 2.03 wt. % Mo, 1.91 wt. % Fe, 0.085 wt. % 0 and the balance being titanium;

said temperature of the step of superplastic-forming is 795° C.;

the superplastically formed titanium alloy is heated to a temperature of 820° C.;

said cooling rate of the titanium alloy is 1° C./sec; and said aging is performed at 510° C. for 3 hours.

34. The method of claim 23, wherein said α+β-titanium alloy consists essentially of 4.38 wt. % Al, 3.02 wt. % V, 2.03 wt. % Mo, 1.91 wt. % Fe, 0.085 wt.% 0 and the balance being titanium;

said temperature of the step of superplastic-forming is 775° C.;

the superplastically formed titanium alloy is heated to a temperature of 785° to 870° C.;

the diffusion-bonding is performed at a temperature of 785° to 870° C.;

said cooling rate of the diffusion-bonded titanium alloy is 0.5° C./sec;

said aging is performed at 510° C. for 6 hours.

* * * * *